US005221210A

United States Patent [19]

Bormuth et al.

[11] Patent Number: 5,221,210

[45] Date of Patent: Jun. 22, 1993

[54] CIRCUITE BOARD CONNECTOR

[75] Inventors: Peter Bormuth, Bensheim; Bernhard H. Schnaubelt, Zwingenberg, both of Fed. Rep. of Germany

[73] Assignee: AMP Incorporated, Harrisburg, Pa.

[21] Appl. No.: 860,942

[22] Filed: Mar. 31, 1992

[30] Foreign Application Priority Data

Apr. 2, 1991 [DE] Fed. Rep. of Germany ..... 9103960

[51] Int. Cl.[5] ..... H01R 23/70

[52] U.S. Cl. ..... 439/79

[58] Field of Search ..... 439/79, 80, 595, 733

[56] References Cited

U.S. PATENT DOCUMENTS

| | | | |
|---|---|---|---|
| 3,208,026 | 9/1965 | Ruehlemann | 439/79 |
| 4,077,694 | 3/1978 | Cobaugh et al. | 439/637 |
| 4,772,228 | 9/1988 | Seymour | 439/733 |
| 5,037,316 | 8/1991 | Fukushima | 439/79 |

*Primary Examiner*—Neil Abrams
*Attorney, Agent, or Firm*—Eric J. Groen; Bruce J. Wolstoncroft

[57] ABSTRACT

A circuit board connector comprising an insulating housing and contact elements accommodated therein and each having a securing portion for securing on a circuit board, a contact portion for establishing pluggable contact with a complementary pluggable contact element of a complementary connector, as well as a mounting portion provided therebetween for mounting in said insulating housing. Through-passages located on the side of the circuit board and through which the securing portion of one contact element each can project through the housing floor are of a length and width, respectively, in connector mating direction and transversely thereof, which is at lest as large as the overall dimension of the associated contact element as seen in connector mating direction and transversely thereof, respectively, such that the insulating housing is adapted to be pluggably placed onto contact elements which are already mounted on the circuit board. The insulating housing and at least some of the contact elements are formed with latching means and complementary latching mens, respectively, through which the insulating housing, upon application, is adapted to be brought into latching connection with the contact elements which are already mounted on the circuit board.

9 Claims, 4 Drawing Sheets

CIRCUITE BOARD CONNECTOR

BACKGROUND OF THE INVENTION

1. Field of the Invention

The invention relates to a circuit board connector for mounting to a printed circuit board which can receive in electrical connection, another mating connector.

2. Description of the Prior Art

Such circuit board connectors serve for making electrical conductive tracks on a circuit board carrying printed circuits accessible to a pluggable connection. Conventionally, the insulating housing of the circuit board connector is first loaded with the contact elements, and thereafter the terminal pins of all contact elements in the insulating housing, which project from the housing floor of the insulating housing and constitute the securing portions of the contact elements, are urged simultaneously into associated circuit board holes. Especially when the circuit board connector comprises a large number of contact elements, a considerable force is exerted on the circuit board during this operation of simultaneously inserting the securing portions of all contact elements. This force becomes particularly high when, due to unavoidable manufacturing tolerances, individual ones or some of the securing pins of the contact elements enter the associated circuit board holes obliquely or even hit slightly beside the latter. The force exerted on the circuit board may then reach harmful extents. Furthermore, bends of the securing portions of the contact elements leading as far as uselessness may result.

These problems are to be overcome by the present invention. The circuit board connector of the type indicated at the outset is to be improved such that the forces exerted on the circuit board while the securing portions of the contact elements are urged into the circuit board holes remain relatively low also with large numbers of contact elements to be inserted, and furthermore such that the problems are avoided arising due to oblique insertion or in particular due to missing of the circuit board holes.

SUMMARY OF THE INVENTION

This object is met by a circuit board connector of the type indicated at the outset, which is characterized in that the through-passages, in connector mating direction of the insulating housing as well as transversely thereof, each are of a length and width, respectively, which is at least as large as the overall dimension of the associated contact element as seen in connector mating direction and transversely thereof, respectively, such that the insulating housing is adapted to be pluggably placed onto contact elements which are already mounted on the circuit board, and in that the insulating housing and at least some of the contact elements are formed with latching means and complementary latching means, respectively, through which the insulating housing, upon application, is adapted to be brought into latching connection with the contact elements that are already mounted on the circuit board.

The connector comprises a plurality of contact elements accommodated in a common insulating housing and each having a securing portion for securing on a circuit board, a contact portion for establishing pluggable contact with a complementary pluggable contact element of a complementary connector, as well as a mounting portion provided therebetween for mounting in said insulating housing, said insulating housing having a housing floor on the side of the circuit board and an insertion opening on the side of the complementary connector for the complementary connector housing, a number of contact receiving chambers for receiving the mounting portion of one contact element each, an equal number of through-passages located on the side of the circuit board and through which the securing portion of one contact element each can project through the housing floor, and an equal number of exit openings located on the side of the complementary connector and through which the contact portion of one contact element each can project into the housing insertion opening.

The circuit board connector according to the invention provides the possibility of first mounting the contact elements individually on the circuit board. I. e., the contact elements are successively secured on the circuit board, so that only one single contact element at a time is urged with its securing portion into the associated circuit board hole or holes, respectively. By doing so, the force exerted on the circuit board never is higher than that required for urging one single contact element into the associated circuit board hole or holes. Due to the fact that no attention need be paid any more to tolerance differences that may also be present within one circuit board connector, it can also be ensured without any problem that the securing portion of the individual contact element, which is constituted by one or more securing pins, can always be exactly urged into the associated circuit board hole or holes.

After all necessary contact elements have been secured on the circuit board, the insulating housing then is pluggably placed onto the contact elements mounted on the circuit board and thereby is brought into latching engagement with the contact elements. This placement onto the contact elements mounted on the circuit board is rendered possible in that, according to the invention, the through-passages for the contact elements, which are formed in the housing floor on the side of the circuit board, do not only enable the securing portions to project therethrough, but permit the passage of the entire part of each contact element projecting upwardly from the circuit board.

Advantageous developments of the invention are indicated in the dependent claims.

DETAILED DESCRIPTION OF THE PREFERRED EMBODIMENT

Figure 1:
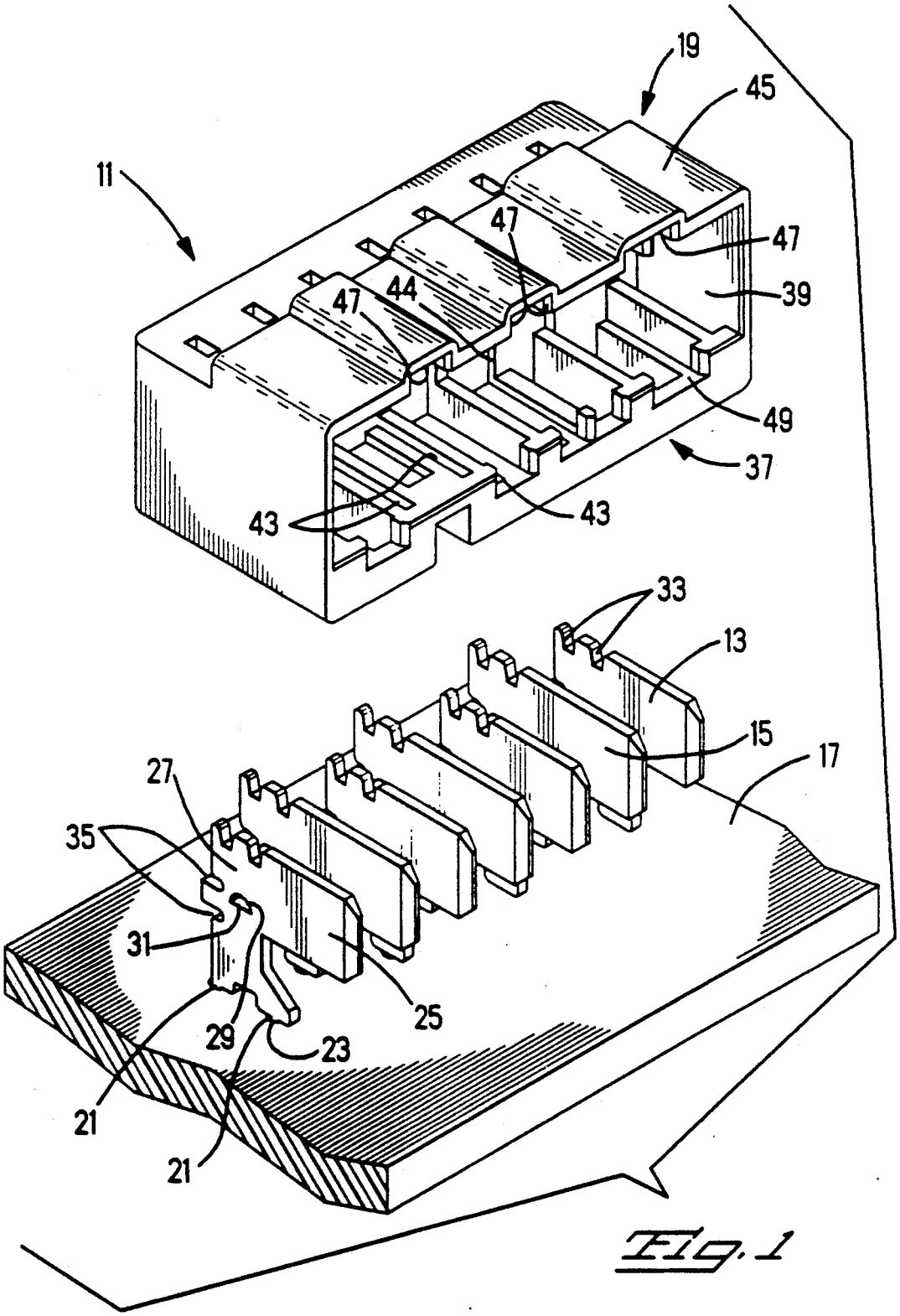
FIG. 1 shows a perspective view of an embodiment of a circuit board connector according to the invention in a pre-mounted condition.

FIG. 1 illustrates a circuit board connector 11 in a pre-mounted condition. I. e., that a number of short contact elements 13 and long contact elements 15 is already mounted on a circuit board 17. An insulating housing 19 is located in a position prior to plug-like application thereof onto the contact elements 13, 15 mounted on circuit board 17.

Each contact element is substantially of L-shaped configuration. Adjoining the free end of the short leg of the L-shape is a securing portion in the form of two securing pins 12. Each securing pin 21 is inserted in an associated circuit board hole 23, where it is secured preferably by soldering and is in electrical contact with a track of circuit board 17. The long leg of each contact element 13, 15 constitutes a tab- shaped contact portion 25 adapted to be received in a tab receiving socket of a complementary connector, not shown.

The short leg and the transition portion between short leg and long leg constitute a mounting portion 27 of the contact element. This mounting portion 27 has a semi-circular embossed projection 29 having a latching shoulder 31 facing toward circuit board 17. Each contact element has at its upper end two positioning notches 33 spaced apart in the direction of extension of the long leg.

The contact elements 13, 15 are each constituted by a plate-shaped flat stamped part. During production thereof, the individual contact elements 13 and 15, respectively, remain interconnected with the aid of a carrier strip. While processing steps subsequent to stamping are performed and until the contact elements 13 and 15, respectively, are singularized upon mounting thereof on the circuit board 17, the contact elements 13 and 15, respectively, can thus be handled more easily.

On the vertical side remote from contact portion 25, each contact element 13, 15 has two incision-type notches 35. The material portion left between these two notches 35 is the remainder of a web through which the individual contact element 13, 15 was attached to a carrier strip.

Adjacent contact elements 13, 15 have different lengths in the longitudinal direction of extension of contact portions 25, so that the securing pins 21 of adjacent contact elements 13, 15 can be spaced apart from each other by a larger distance. This increases the electrical creepage distance between adjacent contact elements 13, 15. Moreover, the associated soldering lands of the securing pins 21 of adjacent contact elements 13, 15 are then located apart by a greater distance, which allows adjacent contact elements 13, 15 to be arranged beside each other more closely.

Insulating housing 19 has a housing floor 37 on the side of the circuit board and an insertion opening 39 on the side of the complementary connector for the complementary connector housing. Adjacent the end of the insertion opening 39 remote from the insertion side there are provided contact receiving chambers 41 for receiving the mounting portion 27 of one contact element 13, 15 each. These contact receiving chambers 41 can be seen best in FIG. 6. The contact receiving chambers 41 communicate on the one hand with through-passages 43 in housing floor 37, through which the securing portion of each contact element 13, 15 can project through the housing floor 37, and on the other hand with exit openings 44 which open into the insertion opening 39 and through which the contact portion 25 of one contact element 13, 15 each can project into the insertion opening 39. The through-passages 43, in connector mating direction of the insulating housing 19, each are of a length which is at least as large as the overall dimension of the associated contact element 13, 15 as seen in connector mating direction, and of a width which is slightly larger than the thickness of each contact element 13, 15, such that the insulating housing 19 is adapted to be pluggably placed onto contact elements 13, 15 that are already mounted on the circuit board 17.

FIG. 1 reveals only part of the through-passages 43 and of the exit openings 44. Additional through- passages 43 and exit openings 44 are hidden in the perspective view of FIG. 1.

The top side wall 45 of insertion opening 39, which is located at the top in FIG. 1, is provided with keying grooves 47. Corresponding keying grooves can be provided in the bottom side wall 39 of insertion opening 39 which is located on housing floor 37. Such keying grooves ensure that only the correct complementary plugs are inserted into the insertion opening 39 and that such insertion takes place in the correct insertion position only.

Figure 2:
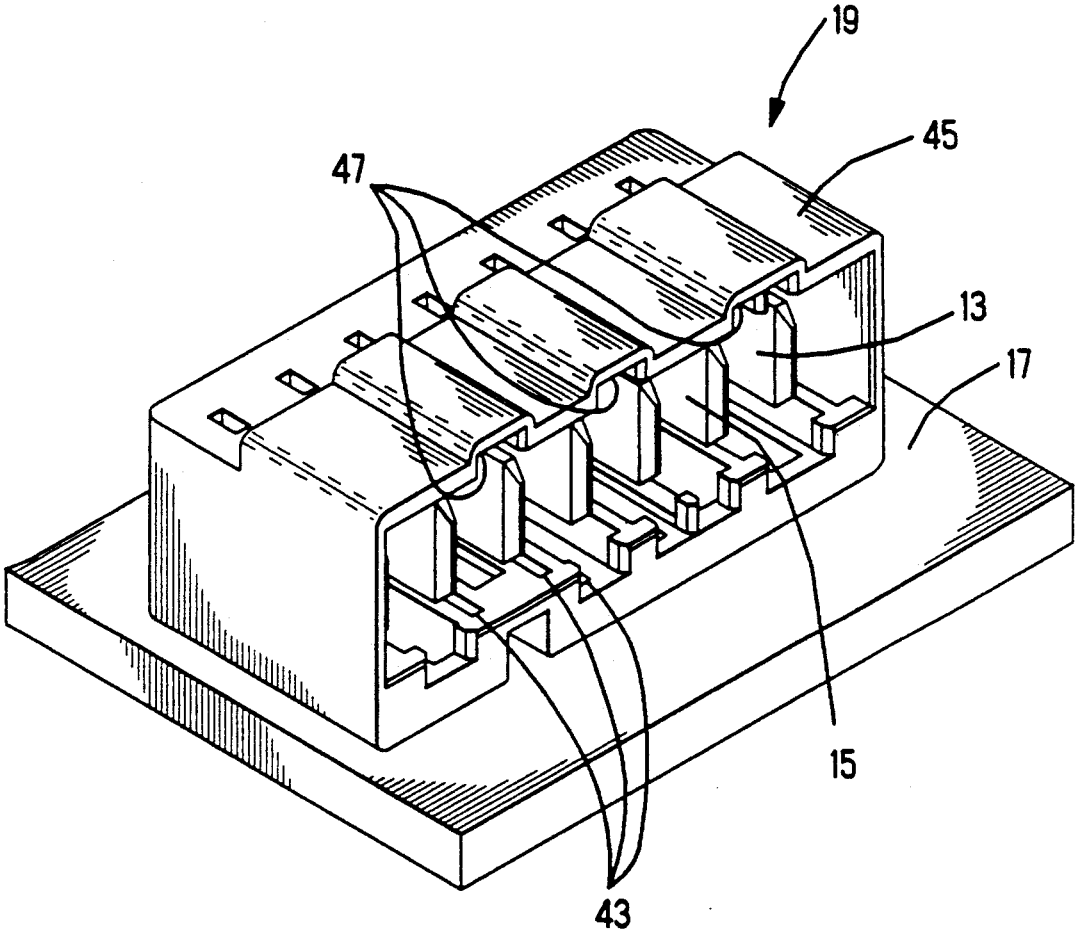
FIG. 2 shows the circuit board connector of FIG. 1 in its final mounting condition.

FIG. 2 shows circuit board connector 11 according to the invention in its finally mounted condition. I.e., the insulating housing 19 is plugged completely onto the contact elements 13, 15 secured on circuit board 17. In this position the insulating housing 19 is latched with the contact elements 13, 15. To this end the insulating housing 19 comprises complementary latching shoulders 51 which are latched with latching shoulders 31 on the contact elements 13, 15 in such a manner that said insulating housing 19 resists withdrawal from the contact elements 13, 15. The complementary latching shoulders 51 will still be elucidated in more detail with reference to FIG. 6.

Figure 3:
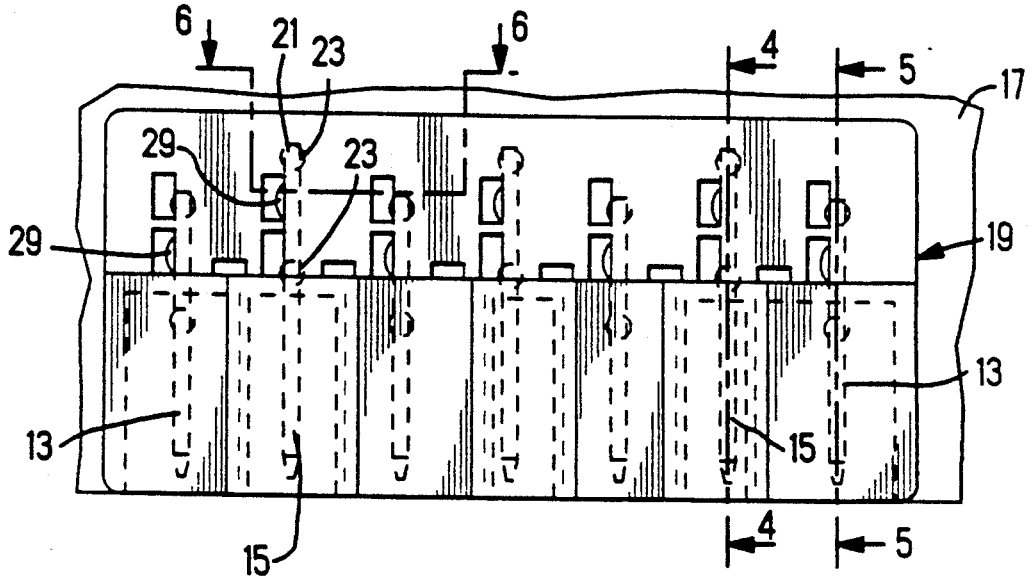
FIG. 3 shows a top plan view of the circuit board connector in its final mounting condition.

FIG. 3 shows a top plan view of the circuit board connector 11 in its finally mounted condition on circuit board 17. The contact elements 13, 15, which are not visible except for the embossed projections 29, are indicated in broken lines. This representation reveals the alternating arrangement of long contact elements 15 and short contact elements 13. The embossed projections 29 with respect to all contact elements 13, 15 are arranged at the same distance from the end of the mounting portion 27 located opposite the contact portion 25. The same holds for the positioning notches 33 of the contact elements 13, 15. In this manner, the same tools each can be used for all contact elements 13, 15 for producing the embossed projections 29 on the one hand and for producing the positioning notches 33 on the other hand.

FIG. 3, furthermore, shows in broken lines the arrangement of the circuit board holes 23 along with the securing pins 21 located therein. As was already mentioned, for adjacent contact elements 13, 15 of different lengths, the two circuit board holes 23 with the mounting pins 21 contained therein are offset from each other in connector mating direction.

Figure 6:
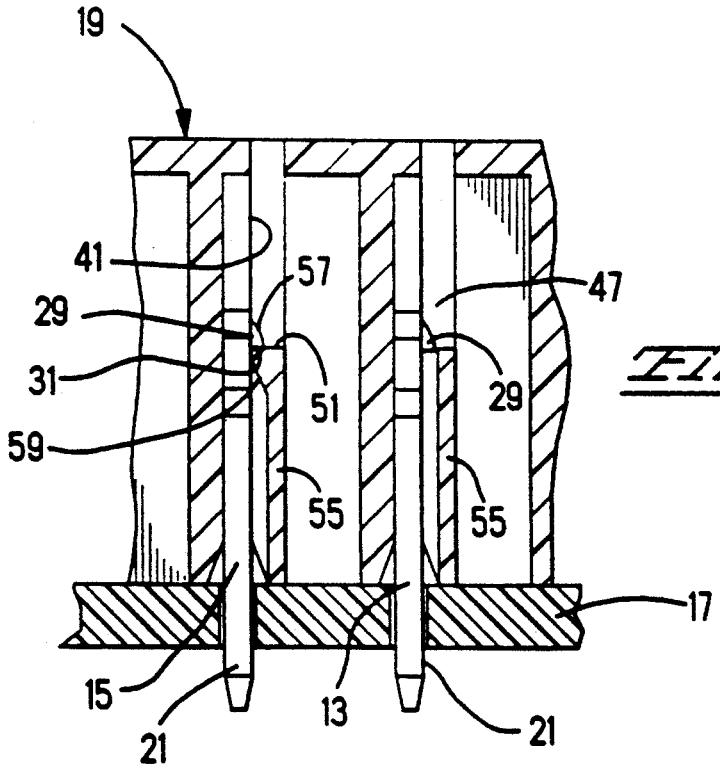
FIG. 6 shows a fragmentary sectional view for illustrating a latching connection between contact element and housing of the circuit board connector.
Figure 4:
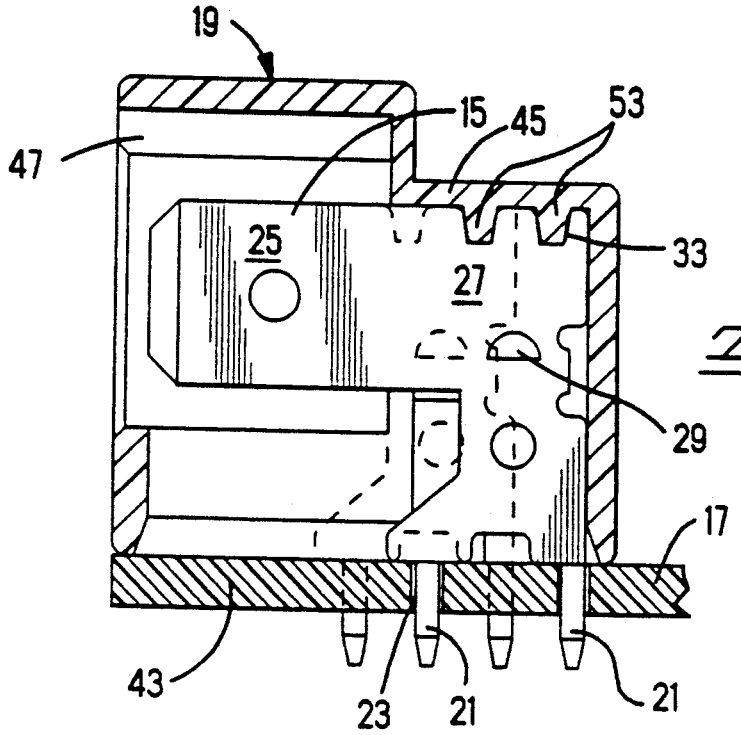
FIG. 4 shows a sectional view of the circuit board connector in its final mounting condition for illustrating a long contact element.
Figure 5:
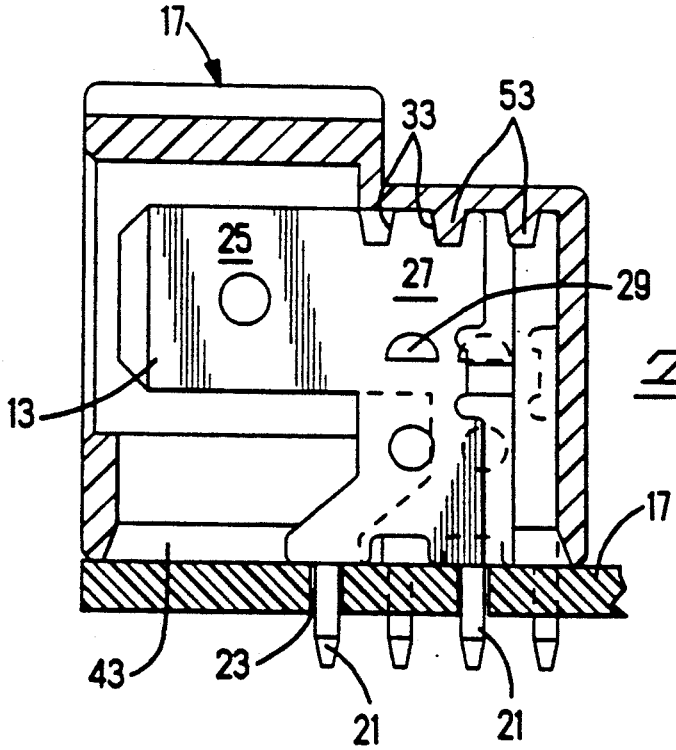
FIG. 5 shows a sectional view according to FIG. 4 for illustrating a short contact element.

Moreover, FIG. 3 shows sectional lines 4 to 6 along which sections have been made on which the sectional views of FIGS. 4 to 6 are based.

The sectional view of FIG. 4 made along sectional line 4—4 in FIG. 3 shows the position of a long contact element 15 within insulating housing 19. This figure shows how the positioning projections on the top side wall 45 of insulating housing 19 engage in the positioning notches 33 in the mounting portion 27 of the contact element 15. The positioning notches 33 and the positioning projections 53 are provided with tapered flanks in complementary manner. Also in case the insulating housing 19 is not positioned exactly during pluggable placement thereof onto the premounted contact elements 13 and 15, this ensures exact relative positioning between contact elements 13, 15 and insulating housing 19.

The through-passage 43 for the contact element 15 can be seen above circuit board 17. This through-passage, as seen in connector mating direction, extends across the entire length of the contact element 15.

FIG. 5 shows the sectional view along sectional line 5—5 in FIG. 3. This view shows the position of a short contact element 13 within insulating housing 19. In this case, only one of the positioning projections 53 engages in one of the two positioning notches 33.

FIG. 6 shows a sectional view of part of the circuit board connector, along sectional line 6—6 in FIG. 3. In contact receiving chamber 41 shown on the left side in FIG. 6 there is located a long contact element 15, whereas a short contact element 13 is located in contact receiving chamber 41 shown on the right side in FIG. 6. In the embodiment depicted in FIG. 6, only the latching shoulder 31 of the long contact element 15 has a complementary latching shoulder 51 located opposite thereto. In the contact receiving chamber 41 for the short contact element 13, there is no latching effect taking place with the embossed projection 29. It is sufficient when latching takes place only between part of the contact elements 13, 15 fixed on circuit board 17 and the insulating housing 19.

In the embodiment shown in FIG. 6, the complementary latching shoulder 51 is constituted by a free end remote from the housing floor 37 of a sidewall 55 of the associated contact receiving chamber 41, said sidewall in the applied condition of insulating housing 19 extending upwardly substantially so as to reach the latching shoulder 31.

Both the latching shoulder 31 and the complementary latching shoulder 51 each have a ramp slope 57 and 59, respectively, associated therewith. Ramp slope 57 is constituted by the shape of the embossed projection 29 in the form of a sector of a sphere. The ramp slope 59 of the complementary latching shoulder 51 is constituted by an inclination of the portion of sidewall 55 adjacent said complementary latching shoulder 51. During placement of the insulating housing 19 onto the contact elements 13, 15 secured on circuit board 17, the ramp slope 59 as seen in FIG. 6 is first located above ramp slope 57. When the insulating housing is pushed downwardly, the two ramp slopes 57 and 59 contact each other, resulting in resilient deflection between contact element 15 and that sidewall 55 of the contact receiving chamber 41 that is provided with the complementary latching shoulder 51. After latching shoulder 31 and complementary latching shoulder 51 have been moved past each other, the contact element 15 and the sidewall 55 resile, so that the complementary latching shoulder 51 engages below latching shoulder 31. After this latching operation, the latching shoulder 31 and the complementary latching shoulder 51 resist withdrawal of the insulating housing 19 from the contact elements 13, 15.

We claim:

1. A circuit board connector comprising a plurality of contact elements accommodated in a common insulating housing and each having a securing portion for securing on a circuit board, a contact portion for establishing pluggable contact with a complementary pluggable contact element of a complementary connector, as well as a mounting portion provided therebetween for mounting in said insulating housing, and insulating housing having a housing floor on the side facing the circuit board and an insertion opening for the complementary connector housing, a number of contact receiving chambers for receiving the mounting portion of one contact element each, an equal number of through-passages located on the side facing the circuit board and through which the securing portion of one contact element each can project through the housing floor, and an equal number of exit openings located on a side of the housing oriented to face the complementary connector housing and through which the contact portion of one contact element each can project into the housing insertion opening, characterized in that the through-passages, in connector mating direction of the insulating housing as well as transversely thereof, are of a length and width, respectively, which is at least as large as the overall dimension of the associated contact element as seen in connector mating direction and transversely thereof, respectively, such that the insulating housing is adapted to be pluggably placed onto contact elements which are already mounted on the circuit board, and in that the insulating housing and at least some of the contact elements are formed with latching means and complementary latching means, respectively, through which the insulating housing, upon application, is adapted to be brought into latching connection with the contact elements that are already mounted on the circuit board, to dispose said contact portions in said insertion opening thereby forming a connector receptacle.

2. A circuit board connector according to claim 1, characterized in that the mounting portion of at least one of the contact elements is provided with a latching shoulder facing towards the housing floor and the associated contact receiving chamber of the insulating housing is provided with a complementary latching shoulder facing away from the housing floor, with the latching shoulder engaging over the complementary latching shoulder when the insulating housing is placed onto the contact elements.

3. A circuit board connector according to claim 2, characterized in that the latching shoulder and/or the complementary latching shoulder has a ramp slope associated therewith, by means of which the latching shoulder and the complementary latching shoulder, during the operation of placing the insulating housing onto the contact elements can be moved past each other.

4. A circuit board connector according to claim 3, characterized in that the latching shoulder is constituted by an embossed projection projecting from the mounting portion of the contact element.

5. A circuit board connector according to claim 4, characterized in that the complementary latching shoulder is formed on a sidewall of the associated contact receiving chamber.

6. A circuit board connector according to claim 5, characterized in that the complementary latching shoulder is constituted by a free end of a sidewall of the associated contact receiving chamber remote from the housing floor, said free end extending at the top substantially as far as the latching shoulder when the insulating housing is in its applied condition.

7. A circuit board connector according to claim 6, characterized in that the mounting portion of each contact element is provided, at the top side remote from the securing portion, with at least one positioning notch in which engages a positioning projection projecting from the inner wall of the opposite housing top side when the insulating housing is placed onto the contact elements.

8. A circuit board connector according to at least one of claim 7, characterized in that the contact elements are each plate-shaped flat stamped parts.

9. A circuit board connector according to claim 8, characterized in that the contact elements are each substantially of L-shaped configuration, the long leg forming a tab-shaped pluggable contact portion, the short leg and the portion constituting the transition between long leg and short leg forming the mounting portion, and at least one securing pin projecting from the free end of the short leg forming the securing portion.

* * * * *